US006540538B2

(12) United States Patent
Nakano et al.

(10) Patent No.: US 6,540,538 B2
(45) Date of Patent: Apr. 1, 2003

(54) SOCKET FOR ELECTRONIC ELEMENT

(75) Inventors: Kazunori Nakano, Yokkaichi (JP); Ryo Ujike, Nishitokyo (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 10/147,978

(22) Filed: May 20, 2002

(65) Prior Publication Data

US 2002/0173174 A1 Nov. 21, 2002

(30) Foreign Application Priority Data

May 21, 2001 (JP) ..... 2001-151234

(51) Int. Cl.[7] ..... H01R 11/22
(52) U.S. Cl. ..... 439/266; 439/268; 439/259
(58) Field of Search ..... 439/265–268, 439/259, 260, 330, 331, 68, 342

(56) References Cited

U.S. PATENT DOCUMENTS 5,342,213 A * 8/1994 Kobayashi ..... 439/268
6,149,449 A * 11/2000 Abe ..... 439/268

FOREIGN PATENT DOCUMENTS

JP 2973406 9/1999

OTHER PUBLICATIONS

Shigeru, S. et al., "Contact Opening and Closing Mechanism of IC Socket", Patent Abstracts of Japan, Publication No. 2000–182740, Publication Date Jun. 30, 2000.

* cited by examiner

*Primary Examiner*—Lynn D. Feild
*Assistant Examiner*—Son V. Nguyen
(74) *Attorney, Agent, or Firm*—Finnegan, Henderson, Farabow, Garrett & Dunner LLP

(57) ABSTRACT

A socket of the invention includes a socket body, a plurality of contacts respectively having a movable piece and a stationary piece, a slidable contact moving member and a lever having a pushing portion and a pressing member. A plurality of contact displacing portions of the contact moving member are respectively positioned between the movable and stationary piece of each contact. The contact moving member is urged to prevent the contact displacing portion from moving each movable piece. The pressing member includes a curved fulcrum portion and an operating portion curved oppositely to the fulcrum portion. A first restricting portion of the socket body is in contact with the fulcrum portion and a second restricting portion of the contact moving member can be in contact with the fulcrum portion. The operating portion of the pressing member abuts to the contact moving member.

9 Claims, 6 Drawing Sheets

SOCKET FOR ELECTRONIC ELEMENT

This application is based on Patent Application No. 2001-151234 filed May 21, 2001 in Japan, the content of which is incorporated hereinto by reference.

BACKGROUND OF THE INVENTION

1. Field of the Invention

The present invention relates to a socket for an electronic element such as integrated circuit package, semiconductor device and the like, and in particular to a socket having a contact opening function enables contacts of the socket to open for an insertion of the electronic element into the socket and a removal of the electronic element from the socket.

2. Description of the Related Art

Conventionally, an IC package used in various electronic apparatuses is inserted in an IC socket for the purpose of carrying out an electrical characteristics test and a burn-in and reliability test and of mounting the IC package to a printed circuit board or the like. Conventionally, the IC socket has a generally rectangular socket body and a plurality of contacts arranged in the socket body, each contact including a movable piece and a stationary piece.

Such IC sockets include a socket having a contact opening function for electrically connecting the contact with a package lead and releasing the electric connection of the contact of the socket from the package lead. For example, Japanese Patent No. 2973406 discloses a conventional IC socket with a contact opening function.

In the IC socket of the above-mentioned patent, a plurality of contacts are arranged in a grid pattern on a generally rectangular socket body. The IC socket includes an actuating member having one end rotatably supported by the socket body and the other end having a cam surface (a slanted surface), and a movable plate slidable on the socket body. The movable plate has a cam follower surface in contact with the cam surface of the actuating member. The movable plate has a plurality of contact displacing portions respectively positioned between the movable piece and the stationary piece of each contact. A rotary axis of the actuating member extends parallel to one edge of the socket body. The movable and stationary pieces of each contact are opposite to each other in the direction in which the one edge of the socket body extends substantially perpendicular to the rotary axis of the actuating member.

When the actuating member is rotatably pushed down, the cam surface of the actuating member cooperates with the cam follower surface of the movable plate to slide the movable plate in one direction on the socket body. As the movable plate slides, each of the contact displacing portions of the movable plate moves the movable piece of the contact in one direction against the elastic force of the movable piece. As a result, a distance between the movable and stationary pieces is expanded (the contact is opened) so that the package lead can be inserted into a gap between the movable and stationary pieces of each contact.

When the push-down of the actuating member is released, each of the movable pieces returns to its original position to slide the movable plate in the direction opposite to the one direction and hold the package lead of the IC package in cooperation with the stationary piece opposite thereto. As a result, each of the contacts of the socket is electrically connected to the package lead of the IC package. When one wishes to release the IC package from the socket, the actuating member is again rotatably pushed down.

In the conventional IC socket, the contacts can be easily opened only by rotatably pushing down the actuating member with respect to the socket body as described above. In the conventional IC socket, however, since the movable and stationary pieces of the contact are opposite to each other in the direction in which one edge of the socket body extending substantially perpendicular to the rotary axis of the actuating member, it is difficult to obtain a sufficient displacement of the movable piece if the arrangement density of the contacts in the socket body is high. Accordingly, there is a requirement for an IC socket which can provide easy opening of the contacts and high arrangement density of the contacts in the socket body.

SUMMARY OF THE INVENTION

A socket for detachably holding various electronic elements of the present invention comprises: a socket body; a plurality of contacts arranged in the socket body, the contacts respectively including a movable piece and a stationary piece; a contact moving member slidably supported on the socket body, the contact moving member having a plurality of contact displacing portions respectively located between the movable and stationary pieces of each contact, and the contact moving member being urged to prevent the contact displacing portions from moving the movable pieces; a lever movably supported by the socket body and including a pushing portion at one end thereof and a pressing member at the other end thereof, the pressing member including a curved fulcrum portion and an operating portion curved oppositely to the fulcrum portion to be in contact with the contact moving member; a first restricting portion included in the socket body to be in contact with the fulcrum portion of the pressing member; and a second restricting portion included in the contact moving member, the second restricting portion capable of being in contact with the fulcrum portion of the pressing member.

Another socket for detachably holding various electronic elements of the present invention comprises: a socket body; a plurality of contacts arranged in the socket body, the contacts respectively including a movable piece and a stationary piece; a contact moving member slidably supported on the socket body, the contact moving member having a plurality of contact displacing portions respectively located between the movable and stationary pieces of each contact; and a lever for moving the contact moving member, the lever movably supported by the socket body and including a pushing portion at one end thereof and a pressing member at the other end thereof, the pressing member having substantially an S-shaped cross-section.

According to the present invention, it is possible to easily open each of the contacts only by pushing down the lever. Also, according to the present invention, it is possible to easily increase the arrangement density of the contacts in the socket body.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The socket of the present invention for an electronic element includes a socket body, a plurality of contacts respectively having a movable piece and a stationary piece, a contact moving member having a plurality of contact displacing portions respectively positioned between the movable and stationary pieces of each contact, and a lever having a pushing portion and a pressing member. The contact moving member is urged by an urging means such as a spring so that the contact displacing portion does not cause each of the movable pieces to displace. The lever is movable relative to the socket body between a contact-closing position and a contact-opening position. The pressing member is preferably made from an elastic material and includes a fulcrum portion and an operating portion. Preferably, the pressing member of the lever has substantially an S-shaped cross-section.

When the lever is at the contact-closing position, the fulcrum portion of the pressing member of the lever is hold by a first restricting portion of the socket body and a second restricting portion of the contact moving member, and the operating portion of the pressing member is in contact with the contact moving member. When the lever is at the contact-closing position, the pushing portion of the lever somewhat floats above the socket body.

When the pushing portion of the lever is pushed down at the contact-closing position, the fulcrum portion of the pressing member is apart from the second restricting portion, while being in contact with the first restricting portion, and the operating portion of the pressing member pushes the contact moving member against the urging force of the urging means to move the contact moving member. As the contact moving member moves, each of the contact displacing portions of the contact moving member causes the movable pieces of the contact to displace so that a distance between the movable and stationary pieces is expanded (that is, each of the contacts is made to open). When the push-down of the lever is released, the contact moving member moves to its original position due to the urging force of the urging means.

FIGS. 1 to 5 show the preferred embodiment of the socket of the present invention.

Figure 1:
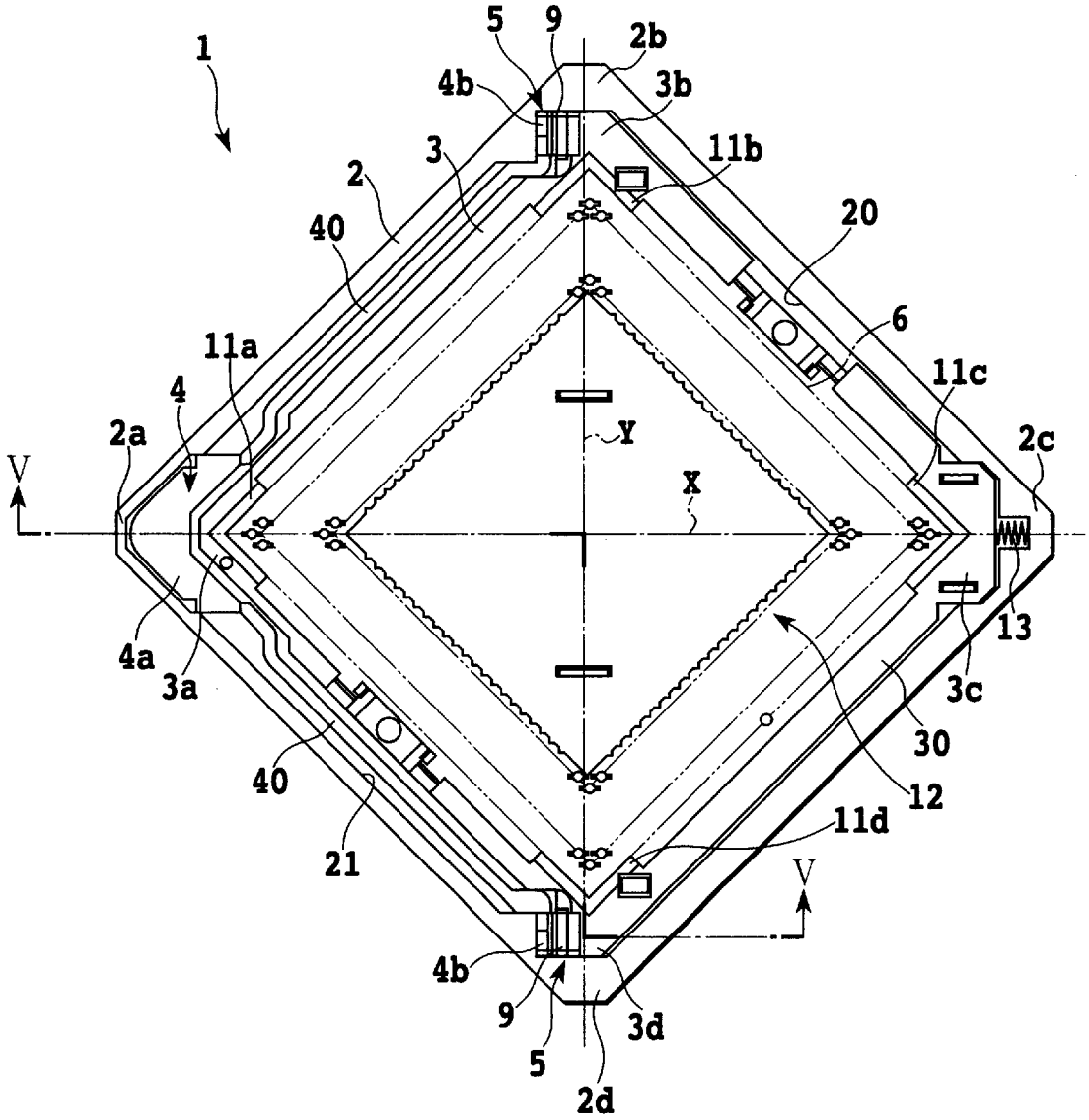
FIG. 1 is plan view of a socket of one embodiment according to the present invention.
Figure 2:
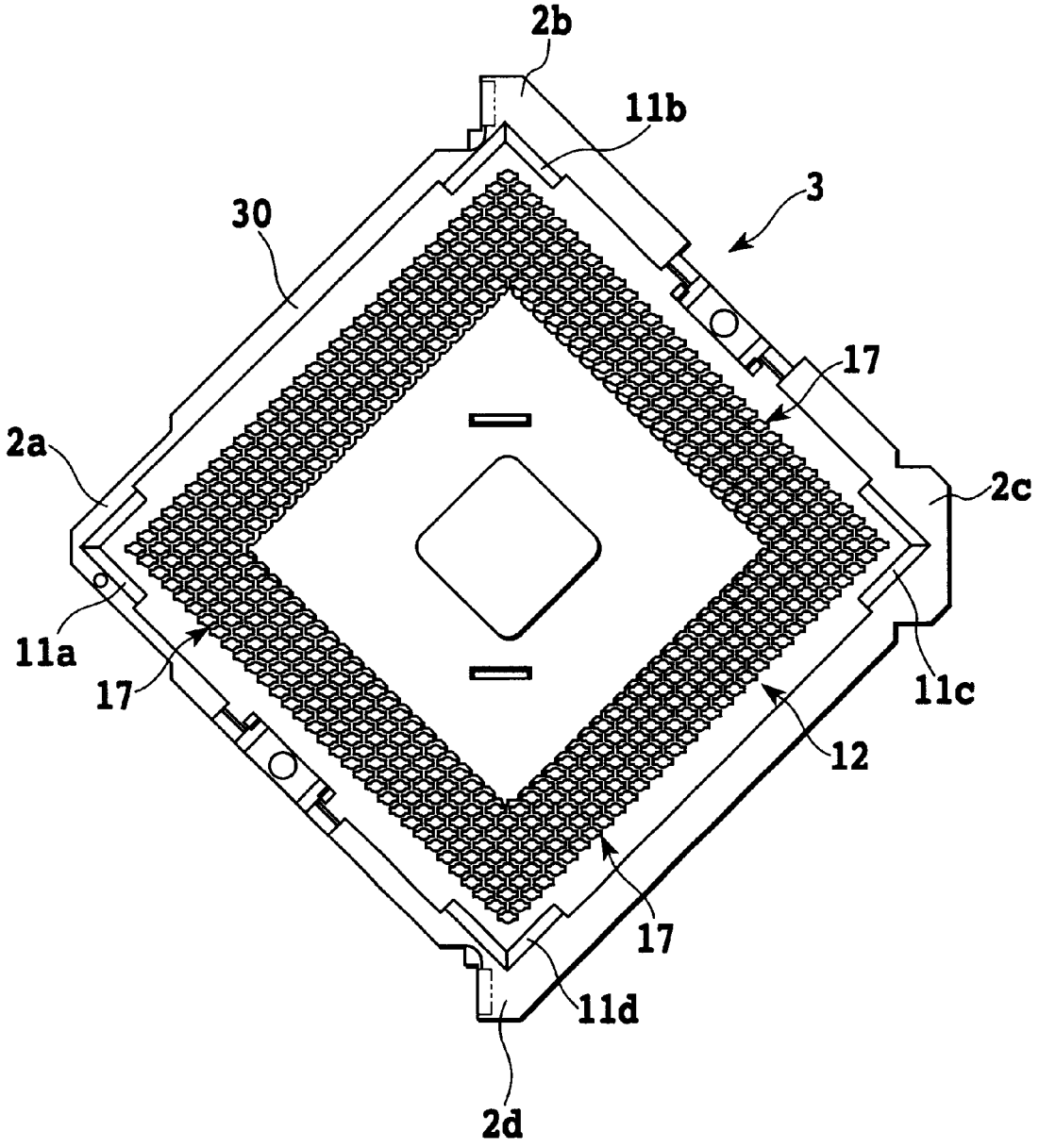
FIG. 2 is a plan view of a contact moving member of the socket shown in FIG. 1.

FIG. 1 is a plan view of one embodiment of the socket according to the present invention for an electronic element. An IC socket 1 of FIG. 1 is capable of detachably holding an IC package 6 of a ball and grid array type (see FIG. 6). The socket 1 includes a generally rectangular socket body 2, a plurality of contacts 8 arranged in the socket body 2 (see FIGS. 5 and 6) and a generally rectangular contact moving member 3 movably held within the socket body 2.

Figure 6:
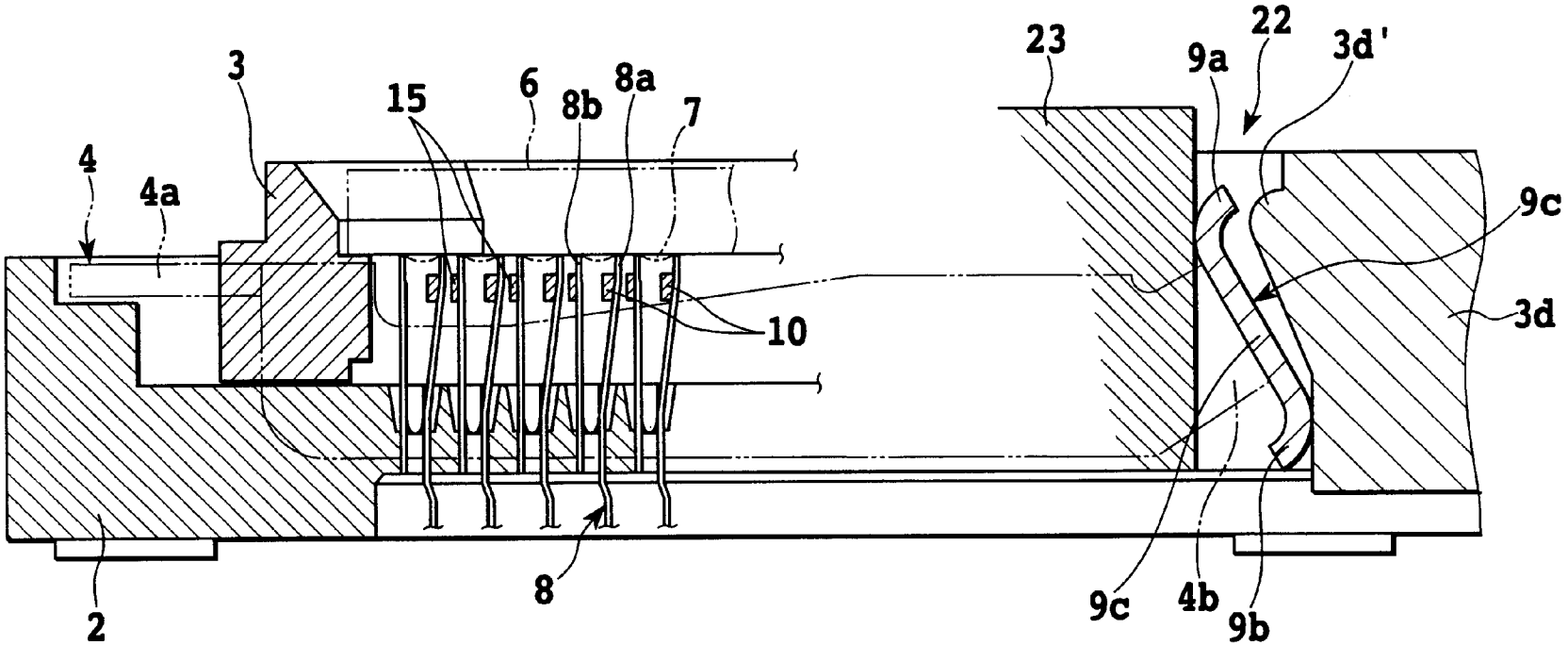
FIG. 6 is a cross section view similar to that of FIG. 5, showing the socket with a lever pushed down.

The contacts 8 are arranged in the socket body 2 in correspondence to the arrangement of package leads 7 of the IC package 6 (see FIG. 6). Each of the contacts includes a movable piece 8*a* and a stationary piece 8*b* made from an elastic material. In this embodiment, the movable piece 8*a* and the stationary piece 8*b* of each contact 8 are opposite to each other in the direction in which one of diagonals (X in FIG. 1) of the socket body 2 extends. Thus, it is possible to easily increase the arrangement density of the contacts 8 in the socket body 2.

The socket body 2 has a chamber 20. The contact moving member 3 is arranged in the chamber 20 of the socket body 2 so that corners thereof 3*a*, 3*b*, 3*c* and 3*d* respectively correspond to corners 2*a*, 2*b*, 2*c* and 2*d* of the socket body 2. An inner dimension of the chamber 20 is slightly larger than an outer dimension of the contact moving member 3. Thus, the contact moving member 3 is slidable within the chamber 20 in the direction in which one of diagonals of the socket body 2 extends (the direction X in FIG. 1). A compressive spring 13 such as a coil spring is disposed between the corner 2*c* of the socket body 2 and the corner 3*c* of the contact moving member 3. The compressive spring 13 urges the contact moving member 3 in the direction X toward the corner 2*a*.

The contact moving member 3 has an outer circumferential frame 30 defining a package mounting area 12 therein. Also, the contact moving member 3 has key-shaped positioning walls 11*a*, 11*b*, 11*c* and 11*d* for positioning the IC package 6 at the corners 3*a*, 3*b*, 3*c* and 3*d*.

Figure 3:
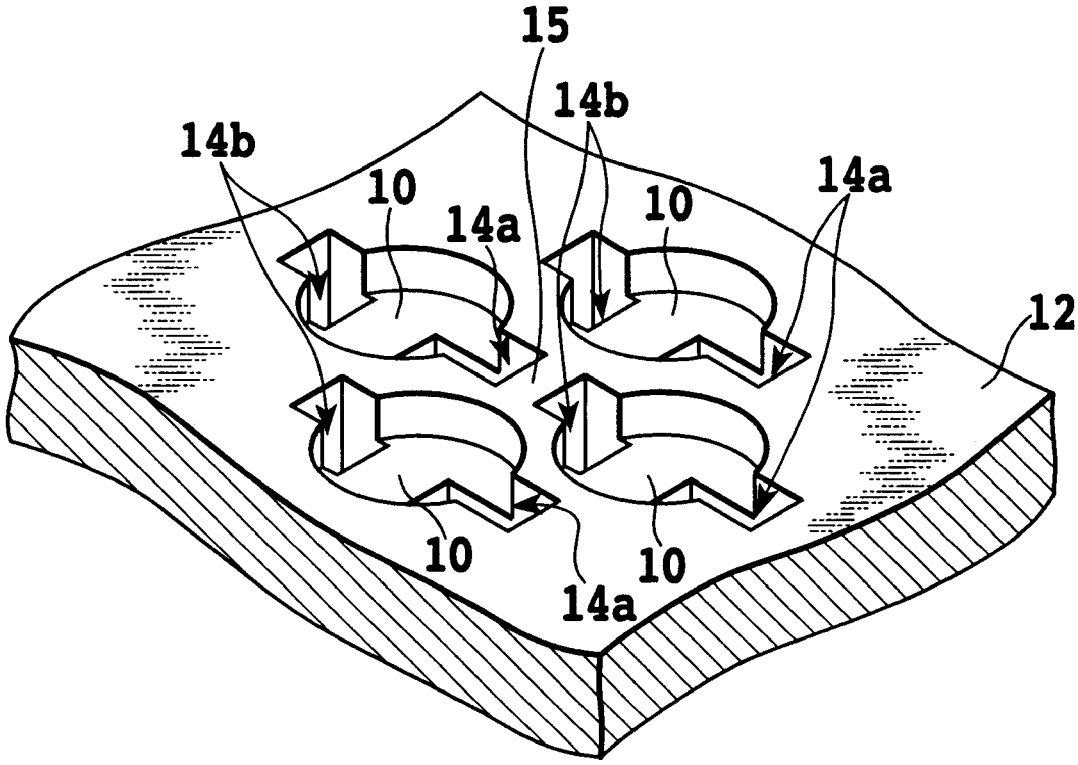
FIG. 3 is an enlarged perspective view of a portion of the contact moving member shown in FIG. 2.
Figure 4:
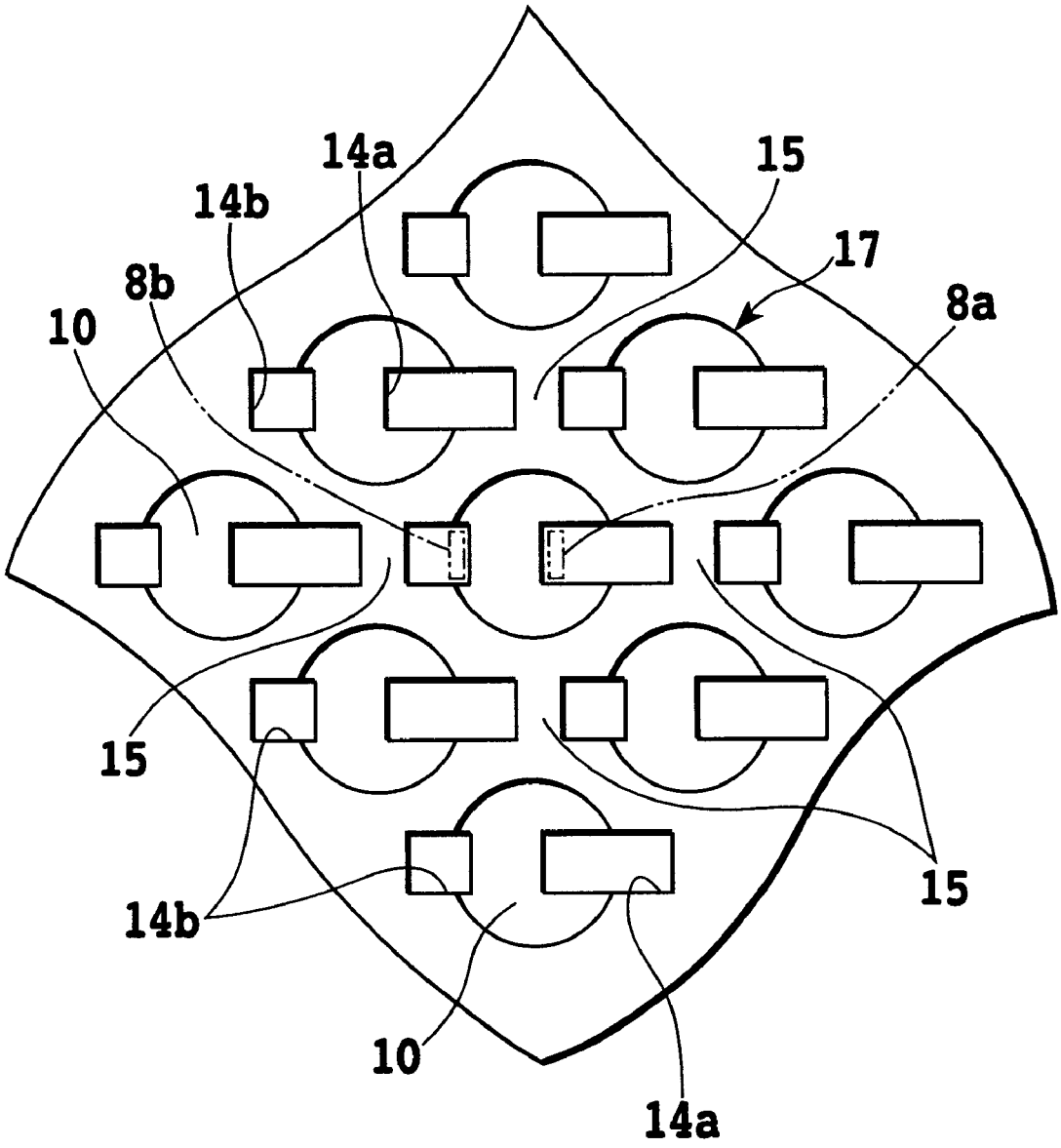
FIG. 4 is an enlarged plan view of a portion of the contact moving member shown in FIG. 2.

As shown in FIGS. 3 and 4, a plurality of sets 17, each including an aperture 14*a*, a contact displacing portion 10 and an aperture 14*b*, are formed in the package mounting area 12 in correspondence to the arrangement of the contacts 8. The movable piece 8*a* of each contact 8 projects upward through the corresponding aperture 14*a*, while the stationary piece 8*b* of each contact 8 projects upward through the corresponding aperture 14*b*. The contact displacing portion 10 is located between the movable piece 8*a* and the stationary piece 8*b*. Also, an insulated portion 15 insulates the movable piece 8*a* and the stationary piece 8*b* of the contacts 8 adjacent to each other.

Further, the socket 1 includes a lever 4 for moving the contact moving member 3. As seen in FIG. 1, the lever 4 includes two arms 40 to define a generally V-shape. A joint portion of the two arms 40 is provided with a pushing portion 4*a*. Also, each of the arms 40 includes a pressing member 9 preferably made from an elastic material at a front end 4*b* thereof.

Figure 5:
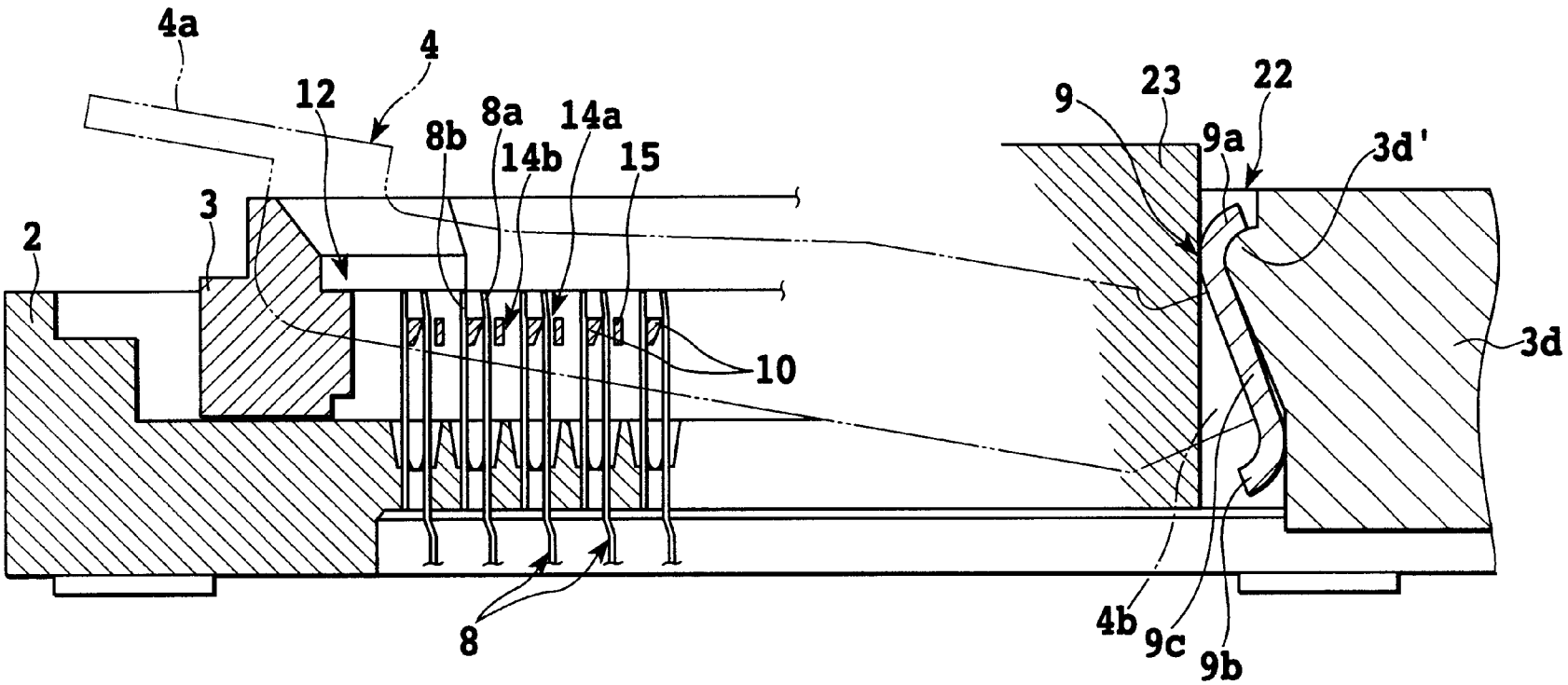
FIG. 5 is a cross section view taken along line V—V of FIG. 1.

As shown in FIGS. 5 and 6, the pressing members 9 respectively include a curved fulcrum portion 9*a*, an operating portion 9*b* curved oppositely to the fulcrum portion 9*a*, and an intermediate portion 9*c* which is interposed between the fulcrum portion 9*a* and the operating portion 9*b* and connected to the front end 4*b* of the arm 40. Thus, the pressing members 9 of the lever 4 have substantially an S-shaped cross-section.

A chamber 21 for the lever 4 (see FIG. 1) is formed in the socket body 2. The chamber 21 exists along two sides of the socket body 2 intersecting each other at the corner 2*a*. The lever 4 is disposed in the chamber 21 so that the pushing portion 4*a* is opposite to the corner 2*a* of the socket body 2. One of the pressing members 9 is held in a supporting portion 22 defined in the vicinity of the corners 2*b* of the socket body 2. The other of the pressing members 9 is held in a supporting portion 22 defined in the vicinity of the corners 2*d* of the socket body 2.

As shown in FIGS. 5 and 6, each of the supporting portions 22 is defined by a restriction wall 23 (a first restricting portion) formed at each of the corners 2*b* and 2*d* of the socket body 2 and a curvature restricting projection 3*b*' and 3*d*' (a second restricting portion) formed at each of the corners 3*b* and 3*d* of the contact moving member 3. In the supporting portion 22, the fulcrum portion 9*c* of the pressing member 9 curves toward the contact moving member 3, and the operating portion 9*a* curves away from the contact moving member 3. A back surface of the fulcrum portion 9*a* of the pressing member 9 is in contact with the restricting wall 23 of the socket body 2 defining the supporting portion 22. Also, the operating portion 9*b* of the pressing member 9 is in contact with a portion of the contact moving member 3 depressed deeper than the curvature restricting projections 3*b*' and 3*d*'. The curvature restricting projections 3*b*' and 3*d*' of the contact moving member 3 project further toward the pressing member 9 than a portion of the contact moving member 3 to be in contact with the operating portion 9*b* of the contact moving member 3. The curvature restricting projections 3*b*' and 3*d*' are configured to have a surface fitted with a front surface of the fulcrum portion 9*a* of the pressing member 9 to be capable of being in contact with the front surface of the fulcrum portion 9*a*.

Since each of the pressing members 9 is supported in the supporting portion 22 in the above-described manner, the lever 4 is substantially rotatable about an axis extending in the direction (the direction Y in FIG. 1) perpendicular to the moving direction (the direction X in FIG. 1) of the contact moving member 3. That is, the lever 4 is movable relative to the socket body 2 between a contact-closing position shown in FIG. 5 and a contact-opening position shown in FIG. 6.

At the contact-closing position shown in FIG. 5, the pushing portion 4*a* of the lever 4 slightly floats above the socket body 2. At the contact-closing position shown in FIG. 5, the fulcrum portion 9*a* of each pressing member 9 is supported by the restriction wall 23 of the socket body 2 and the curvature restricting portion 3*b*' or 3*d*' of the contact moving member 3, while the operating portion 9*b* of each pressing member 9 is in contact with the contact moving member 3.

When the pushing portion 4*a* of the lever 4 is pushed down at the contact-closing position, the fulcrum portion 9*a* of each pressing member 9 is away from the curvature restricting projections 3*b*' and 3*d*' while remaining in contact with the restriction wall 23 of the socket body 2. On the other hand, the operating portion 9*b* of the pressing member 9 pushes the contact moving member 3 against the urging force of the compressive spring 13 to move the contact moving member 3 in the direction X toward the corner 2*c* of the socket body 2. As the contact moving member 3 moves in such a manner, each of the contact displacing portions 10 of the contact moving member 3 displaces the movable piece 8*a* of each contact 8 to expand a distance between the movable member 8*a* and the stationary piece 8*b*. At the contact-opening position in which the pushing portion 4*a* is sufficiently pushed down (see FIG. 6), package leads 7, for example, of a hemispherical or circular stud-like shape can be inserted into the opened contact 8 (that is, gap between the movable piece 8*a* and the stationary piece 8*b*) corresponding thereto with substantially no load.

When the push-down of the lever 4 is released after the IC package 6 has been inserted into the package mounting area 12, the contact moving member 3 moves toward the corner 2*a* of the socket body 2 due to the urging force of the compressive spring 13 (and the elasticity of movable pieces 8*a*). The movable piece 8*a* of each contact 8 approaches the stationary piece 8*b* corresponding thereto and securely holds the corresponding package lead 7 of the IC package 6 in cooperation with the opposite stationary piece 8*b*. Thus, the electric connection is securely and favorably achieved between the package lead 7 and the contact 8.

To remove the IC package 6 from the socket 1, the lever 4 is pushed down again. Again, the contact moving member 3 moves in the same manner as mentioned above to open the contacts 8. When the lever is located at the contact-opening position shown in FIG. 6, the IC package 6 is removable from the socket 1 with a minimum necessary force. After the removal of the IC package 6 from the socket 1, the push-down of the lever 4 is released, then the lever 4 (and the contact moving member 3) returns to its original position in the contact-closing position shown in FIG. 5.

As described above, according to the socket 1, it is possible to easily open the contacts 8 only by the actuation of the lever 4. Also, according to the socket 1, it is possible to securely and favorably make the package lead 7 into contact with the contact 8. Therefore, the IC socket 1 of the present invention facilitates the mounting of the IC package 6 and improves the efficiency of the package mounting process in an automated operation using a robot or the like or a manual operation. Further, according to the socket 1, the reduction of the number of components, the production cost and the manufacturing period are achievable.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A socket for detachably holding various electronic elements, comprising:

a socket body;

a plurality of contacts arranged in said socket body, said contacts respectively including a movable piece and a stationary piece;

a contact moving member slidably supported on said socket body, said contact moving member having a plurality of contact displacing portions respectively located between said movable and stationary pieces of each contact, and said contact moving member being urged to prevent said contact displacing portions from moving said movable pieces;

a lever movably supported by said socket body and including a pushing portion at one end thereof and a pressing member at the other end thereof, said pressing member including a curved fulcrum portion and an operating portion curved oppositely to said fulcrum portion to be in contact with said contact moving member;

a first restricting portion included in said socket body to be in contact with said fulcrum portion of said pressing member; and a second restricting portion included in said contact moving member, said second restricting portion capable of being in contact with said fulcrum portion of said pressing member.

2. A socket as claimed in claim 1, wherein said fulcrum portion of said pressing member is away from said second restricting portion while remaining in contact with said first restricting portion as said pushing portion of said lever is pushed down, and wherein said operating portion of said pressing member pushes said contact moving member against the urge force to move said contact moving member as said pushing portion of said lever is pushed down.

3. A socket as claimed in claim 1, wherein said pressing member of said lever has substantially an S-shaped cross-section.

4. A socket as claimed in claim 1, wherein said second restricting portion of said contact moving member is projected toward said pressing member rather than a portion of said contact moving member which is in contact with said operating portion.

5. A socket as claimed in claim 1, wherein said fulcrum portion of said pressing member is curved toward said contact moving member and said operating portion of said pressing member is curved to be apart from said contact moving member, and wherein said first restricting portion is in contact with a back surface of said fulcrum portion and said second restricting portion can be in contact with a front surface of said fulcrum portion.

6. A socket as claimed in claim 1, wherein said socket body is substantially rectangular, said movable and stationary pieces of each contact are disposed opposite to each other in the direction in which one of diagonals of said socket body extends, and said contact moving member is movable along said one of diagonals of said socket body, and wherein said lever has two arms, each of said two arms including said pressing member at a front end thereof and said pushing portion provided in a joint portion of said two arms.

7. A socket as claimed in claim 1, wherein said contact moving member including an area for mounting an electronic element.

8. A socket as claimed in claim 1, wherein said socket is capable of holding an IC package of a ball grid array type.

9. A socket for detachably holding various electronic elements, comprising:

a socket body;

a plurality of contacts arranged in said socket body, said contacts respectively including a movable piece and a stationary piece;

a contact moving member slidably supported on said socket body, said contact moving member having a plurality of contact displacing portions respectively located between said movable and stationary pieces of each contact; and a lever for moving said contact moving member, said lever movably supported by said socket body and including a pushing portion at one end thereof and a pressing member at the other end thereof, said pressing member having substantially an S-shaped cross-section.

* * * * *